United States Patent [19]

Takahashi et al.

[11] Patent Number: 4,616,695

[45] Date of Patent: Oct. 14, 1986

[54] HEAT EXCHANGER

[75] Inventors: Kenzo Takahashi, Kawanishi; Nobuo Kumazaki, Nakatsugawa; Hisao Yokoya, Tajimi; Hironobu Nakamura; Tadakatsu Kachi, both of Nakatsugawa, all of Japan

[73] Assignee: Mitsubishi Denki Kabushiki Kaisha, Tokyo, Japan

[21] Appl. No.: 699,163

[22] Filed: Feb. 7, 1985

[30] Foreign Application Priority Data

May 11, 1984 [JP] Japan ..... 59-94101

[51] Int. Cl.[4] ..... F24H 3/02

[52] U.S. Cl. ..... 165/54; 165/166

[58] Field of Search ..... 165/166, 54

[56] References Cited

U.S. PATENT DOCUMENTS

| | | | |
|---|---|---|---|
| 1,833,166 | 11/1931 | Lucke | 165/166 |
| 4,051,898 | 10/1977 | Yoshino et al. | 165/166 |

FOREIGN PATENT DOCUMENTS

| | | | |
|---|---|---|---|
| 2451225 | 5/1976 | Fed. Rep. of Germany | 165/166 |
| 0059219 | 5/1954 | France | 165/166 |
| 47-19990 | 6/1972 | Japan . | |
| 52-56531 | 12/1977 | Japan . | |
| 0160297 | 12/1980 | Japan | 165/166 |
| 0070392 | 4/1982 | Japan | 165/166 |
| 2091407 | 7/1982 | United Kingdom | 165/166 |

*Primary Examiner*—William R. Cline
*Assistant Examiner*—Richard R. Cole
*Attorney, Agent, or Firm*—Oblon, Fisher, Spivak, McClelland & Maier

[57] ABSTRACT

A heat exchanger of a construction having a plurality of plates disposed in mutual confrontation at a predetermined spaced interval among them to separate two fluids to be subjected to heat-exchange; a fin disposed in the space interval among the mutually opposed plates to form a plurality of parallel flow paths for controlling flow of the two fluids in the spaced interval, the spaced interval formed by the plates being in a plurality of stacked layers, and the portion where the fin is present and the empty space where no fin is present being so disposed in the plurality of space intervals in layer form that they may be staggered in the direction of stacking the plates; and a control member provided in each of the space intervals in layer form to separate and alternately lead into each space interval the primary fluid and the secondary fluid so as to effect the heat exchanging operation between the primary fluid and the secondary fluid in the course of their passage through the spaced interval in layer, while producing a flow rate distribution in each of the fin sections and the empty sections by a static pressure loss distribution in the fin section.

13 Claims, 26 Drawing Figures

HEAT EXCHANGER

FIELD OF THE INVENTION

This invention relates to a plate-fin type heat exchanger excellent in its heat exchanging efficiency, and, more particularly, it is concerned with a heat exchanger which has been rendered remarkably efficient by imparting to two different fluids to be heat-exchanged a flow rate distribution of the fluid proper.

DISCUSSION OF THE BACKGROUND

The plate-fin type heat exchanger has a large heat transmission area per unit volume, and has been widely used as a heat exchanger in a small size and having a high operating efficiency.

When the cross-sectional shape of the plate-fin type heat exchanger is illustrated in a square as shown in FIGS. 1(A), 1(B), and 1(C) of the accompanying drawing, a primary fluid to be heat-exchanged is denoted by an arrow marked in a solid line, a secondary fluid is denoted by an arrow marked in broken lines (as a matter of course, the primary fluid and the secondary fluid are separated by a partition plate). The heat exchanger is classified by the flow of these two fluids and can be broadly classified into a parallel flow type heat exchanger 22, in which the two fluids flow in mutually intersecting directions, this being an intermediate type between the parallel flow type and the counter-flow type heat exchangers. When the heat exchanging efficiency of these plate-fin type heat exchangers 20, 21 and 22 is expressed by $\eta$, and temperatures at both inlet and outlet ports for the primary fluid and the secondary fluid are respectively denoted as $T_1$, $t_1$, $T_2$ and $t_2$ as shown in FIGS. 1(A), 1(B) and 1(C), the heat exchanging efficiency $\eta$ can be represented as follows.

$$\eta = \frac{T_1 - T_2}{T_1 - t_1} \times 100 = \frac{t_2 - t_1}{T_1 - t_1} \times 100(\%) \qquad (1)$$

Here, the temperatures $T_2$ and $t_2$ at the outlet ports of the heat exchanger vary depending on the flow rates of both fluids; however, the temperatures of both fluids which are in mutual contact through a plate become substantially coincident, if and when both fluids are caused to flow at a very low speed. As a result of this, the temperatures $T_2$ and $t_2$ are substantially equal ($T_2 \approx t_2$) in the parallel flow type heat exchanger, and, from the above equation, $T_2 \approx (T_1+t_1)/2$, hence $\eta \approx 50\%$. In other words, the maximum heat exchanging efficiency of the parallel flow type heat exchanger becomes 50%. Also, the temperatures $T_1$, $t_1$, $T_2$ and $t_2$ are in a relationship of $T_2 \approx t_1$, $t_2 \approx T_1$ in the counter-flow type heat exchanger 21, and, from the above equation (1), $\eta \approx 100\%$. That is to say, if it is possible to effect the heat exchanging operation under the ideal conditions with a perfectly heat-insulated system, the counter-flow type heat exchanger exhibits its maximum heat exchanging efficiency of 100%. On the other hand, the orthogonally intersecting flow type (or slantly intersecting flow type) heat exchanger 22 is classified in between the parallel flow type heat exchanger 20 and the counter-flow type heat exchanger 21, so that the maximum heat exchanging efficiency thereof ranges from 50% to 100% depending on an angle, at which the two fluids intersect. From the above, it may be understood that the counter-flow type heat exchanger 21 is ideal, in its actual use, the two fluids cannot be separated perfectly, because the inlet and outlet ports of these two fluids to be heat-exchanged are in one and the same end face, hence such ideal counter-flow type heat exchanger 21 is non-existent. In the following discussion, actual circumstances in the heat exchanging operations will be explained by reference to an air-to-air heat exchanger used in the field of air conditioning.

Recently, the importance of ventilation in a living space to increase its air conditioning (cooling and warming) effect has again been brought to attention of all concerned, as the heat insulation and the air tightness characteristics of the living space from an external atmosphere has been improved. As an effective method of ventilation of the living space without affecting the cooling and warming effect, there has been suggested one that carries out the heat exchanging operation between exhaustion of contaminated air in the room and intake of fresh external air. In this case, a remarkable effect has results where the exchange of humidity (latent heat) can be done simultaneously with exchange of temperature (sensible heat). As an example of a method for attaining such purpose, there has been put into practice an orthogonally intersecting flow type (or a slant intersecting flow type) heat exchanger as shown in FIG. 2 which has been known by Japanese Patent Publication No. 19990/1972. In the drawing, numeral 1 refers to partitioning plates to separate the intake air and the exhaust air, and numeral 2 refers to fins which form a plurality of parallel flow paths for guiding the intake air or the exhaust air.

For the size-reduction or the high performance of the heat exchanger, the above-mentioned counter-flow type is preferable. While it is considered impossible to realize the plate-fin type heat exchanger which is of the perfect counter-flow type and which is capable of industrialized mass-production, there are several laid-open applications which have realized, in part, such counter-flow system. Of these, Japanese Utility Model Publication No. 56531/1977 appears to be the one with the highest practicability, and the following explanation is given as to the heat-exchanger disclosed in this utility model publication as an example of known art. The heat exchanger as taught in this published specification is of such a construction that corrugated heat exchanging elements 3 in a square or a rectangular shape are piled up in a staggered form, as shown in FIG. 3(A), each end part 4 of which is fitted into an opening 6 formed in a closure plate 5 shown in FIG. 3(B) to tightly close the adjacent heat exchanging element 3, 3. In addition, reference letter (M) in the drawing designates a flow of the primary air current, and reference letter (N) denotes a flow of the secondary air current. In this heat exchanger, each air current, after it has passed through the heat exchanging elements 3, impinges on the closure plate 5 through an empty space (S) formed between the adjacent heat exchanging elements 3, 3 to thereby perpendicularly divert its flow direction.

The published specification does not contain a description as to the performance of the heat exchanger, except for simply stating convenience in its use. As a potential structural defect, however, it may be presumed that automated manufacturing of this heat exchanger is difficult to be implemented because the end parts 4 of the heat exchanging elements 3, 3 in corrugated form have to be fitted into the openings 6 of the closure plate 5 to manufacture the heat exchanger, hence the apparatus is lacking in an industrialized mass-productivity capability.

SUMMARY OF THE INVENTION

In view of the above-mentioned situation, the present inventors have made strenuous efforts in studies and research for development of a plate-fin type heat exchanger having its performance as high as that of the counter-flow type heat exchanger and being adapted to industrialized mass-production. As the result of this, they successfully completed the production of a heat exchanger of an extremely high performance which breaks through a barrier of the common sense in the conventional plate-fin type heat exchanger and which transcends the theoretical heat exchanging efficiency of the cross-flow type heat exchanger.

That is to say, the present inventors have discovered that an extremely high heat exchanging efficiency as mentioned above could be realized with a heat exchanger which comprises a plurality of plates disposed in mutual confrontation at a predetermined spaced interval to separate two fluids to be heat-exchanged, and a fin disposed in the above-mentioned spaced interval among the mutually opposed plates to form a plurality of parallel flow paths for controlling flow of said two fluids in the spaced interval; wherein the spaced intervals to be formed by the above-mentioned plates exists in a plurality of stacked layers, and the portion where the fin is present and the empty space where no fin is present are so disposed in these plurality of spaced intervals is such that they may be staggered in the direction of stacking the plates; and wherein, at the same time a control member is provided in each of the above-mentioned spaced intervals to separate and alternately lead into each spaced interval the primary fluid and the secondary fluid so that the heat exchanging operation may be effected between the above-mentioned primary fluid and secondary fluid as led into each of the spaced intervals form through the partitioning plate in the course of their passage through the spaced intervals in layer form, while producing a flow rate distribution in each of the fin sections and the empty sections by a static pressure loss distribution in the fin sections. Based on this discovery, they completed the present invention.

BRIEF DESCRIPTION OF THE DRAWINGS

One way of carrying out the present invention is described in detail below with reference to drawings which illustrate several specific embodiments thereof, in which.

DESCRIPTION OF THE PREFERRED EMBODIMENTS

In the following, the present invention will be described in detail by taking an air-to-air heat exchanger used in the field of the air conditioning technology, as an example.

Figure 4:
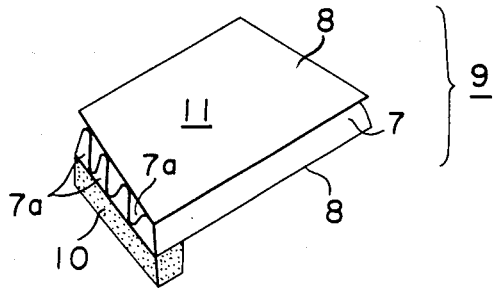
FIG. 4 is a perspective view of a unit member to be used for an embodiment of the present invention.

FIG. 4 is a perspective view showing one example of a unit member to construct the heat exchanger according to the present invention. This heat exchanging element is of a construction such that plates 8 for partitioning two air currents to be heat-exchanged are first fixed with an adhesive agent, etc. onto both upper and lower ends of a fin 7 in corrugated form to produce a plurality of parallel flow paths *7a* for controlling flow of the fluids; then one end of the fin section is cut in the direction perpendicular to the parallel flow paths *7a* to distribute static pressure loss in the fin section, and the other end thereof is cut obliquely, thereby fabricating the heat exchanging element 9; and, finally, a spacer 10 which also functions as a guide for the air current is fixed with an adhesive agent, etc. onto this obliquely cut other end of the fin section, thereby completing the unit member 11. As the material for the plate 8, a thin metal plate, ceramic plate, plastic plate, and various others may be contemplated. In the case, however, of effecting the humidity exchange along with the temperature exchange between the intake air and the exhaust air in the above-mentioned field of the air conditioning technology, use should preferably be made, of a porous material, of processed paper having a moisture permeability, which is prepared by treating the paper with a chemical. The same materials as used for the plate may also be employed for the fin 7, although kraft paper is suitable for the air conditioning purpose. The same materials as used for the plate and the fin may also be used for the spacer 10, although hardboard paper or plastic plate is suitable for the air conditioning purpose. The thickness of the plate 8 and the fin 7 should preferably be as thin as possible within a permissible range of their mechanical strength, a range of about 0.05 to 0.2 mm or so being suitable. The height of the fin 7 (corresponding to a space interval between the adjacent plates 8)) and the pitch thereof (in the case of the corrugated fin as in the embodiment of the present invention, a space interval between adjacent ridges) should preferably be in a range of from 1 to 10 mm, because, when they are too high, the straightening effect of the air current is small, and, when they are too low, the static pressure loss becomes large. In the preferred embodiment of the present invention, the height of the fin is set at 2.0 mm or 2.7 mm, and the pitch thereof at 4.0 mm. The thickness of the spacer 10 is required to be precisely uniform in the state wherein the fin 7 is sandwiched at an upstream position between two plates 8. In case the number of the unit members to be stacked, i.e., the number of the stacked layers, is more than 100 as in the preferred embodiment of the invention, the thickness of the spacer 10 should be uniform, otherwise no heat exchanger of a regular configuration can be obtained. Fixing of the spacer 10 is done by use of an adhesive agent available in the general market.

Figure 5:
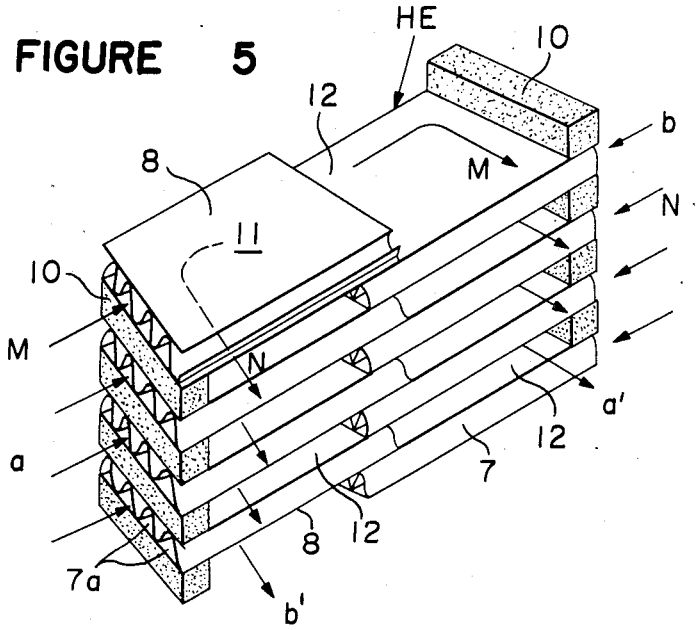
FIG. 5 is a perspective view of a heat exchanger having a trapezoidal cross-section, and which constitutes one embodiment of the present invention.

FIG. 5 illustrates a perspective view of a heat exchanger (HE), wherein a cross-sectional shape of the stacked unit members 11 of FIG. 4 takes a trapezoidal form. In the drawing, reference letters, a, a' designate respectively an inlet port and an outlet port for the primary air current (M), while reference letters b, b' respectively denote an inlet port and an outlet port for the secondary air current (N). The heat exchanging element 9 is of a trapezoidal shape with the rear edge as its short side, wherein the static pressure loss at the fin section 7 is maximum at its front part and becomes smaller towards the rear part. On account of such construction of the element, the air currents (M) and (N) form their flow rate distribution at the fin section 7 such that they collect at the rear part of the element as indicated by an arrow mark in the drawing, where the static pressure loss is small. The air currents are also smoothly led out to their respective outlet ports a' and b' along the spacer 10 also having the function of the guide for the current, while collecting at the rear part of the element as shown by an arrow mark, even at the empty section 12 formed between the adjacent plates 8, 8.

Figure 6:
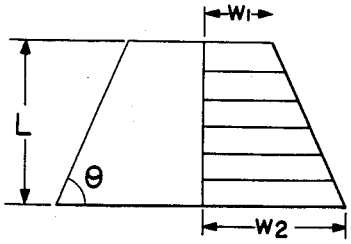
FIGS. 6(A), 6(B), and 6(C) are explanatory diagrams illustrating cross-sectional shapes of test heat exchanges fabricated for explaining the performance of the heat exchanger according to the present invention.
Figure 6:
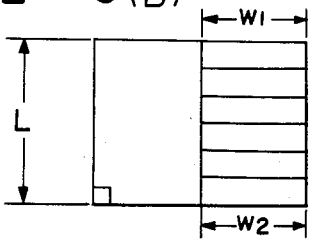
Figure 6:
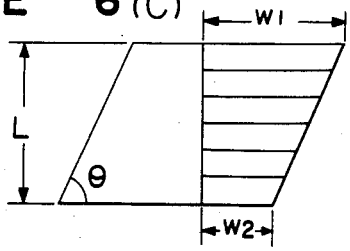

In the following, detailed explanations will be made as to the results of evaluating the performance of the heat exchanger according to the present invention. For explanation of the flow rate distribution of the air current in the heat exchanger, heat exchangers having cross-sectional shapes as shown in FIGS. 6(A), 6(B) and 6(C) were manufactured for test purposes. FIG. 6(A) represents the cross-sectional shape of the heat exchanger shown in FIG. 5. In the illustration, the right half portion with hatched lines denotes the fin section 7, and the left half portion thereof indicates the empty section 12. (This corresponds to the cross-section at the second stack from the top in FIG. 5.) When the manner of stacking the unit member 11 shown in FIG. 4 is changed, there may be obtained the heat exchanger having a parallelogrammic cross-section, as shown in FIG. 6(C). On the other hand, if both ends of the unit member 11 in FIG. 4 are cut perpendicularly with respect to the parallel flow paths, there may be obtained a heat exchanger having a rectangular cross-section as indicated in FIG. 6(B), which is classified as an intermediate between the trapezoid and the parallelogram. Moreover, since there comes out a difference in the effect of the flow rate distribution of the air current owing to an angle $\theta$ (angle $\theta$ as noted in FIGS. 6(A) and 6(C) when the end part of the fin section is cut obliquely with respect to the parallel flow paths, two kinds of test heat exchanger having an angle $\theta$ of 45° and 60° were also manufactured, thereby fabricating, in total, five kinds of the heat exchanger. In order to make clear the cross-sectional shape of these heat exchangers, the values $W_1$ and $W_2$ shown in FIGS. 6(A), 6(B) and 6(C) are tabulated in the following Table 1. The test heat exchangers were all given a uniform length of 300 mm, a uniform height of 500 mm, and a uniform heat transmitting area of approximately 24 $m^2$. Also, since the static pressure loss distribution at the fin section 7 can be quantitatively expressed in terms of a ratio $W_1/W_2$ between the top end length and the bottom end length of the fin section, such values have also been included in Table 1.

TABLE 1

| | Shape | | | | |
|---|---|---|---|---|---|
| | Trapezoid | | Rectangle | Parallelogram | |
| | $\theta$ | | | | |
| Size | 45° | 60° | 90° | 60° | 45° |
| $W_1$ (mm) | 50 | 125 | 200 | 275 | 350 |
| $W_2$ (mm) | 350 | 275 | 200 | 125 | 50 |
| $W_1/W_2$ | 0.14 | 0.45 | 1.0 | 2.2 | 7.0 |

Figure 7:
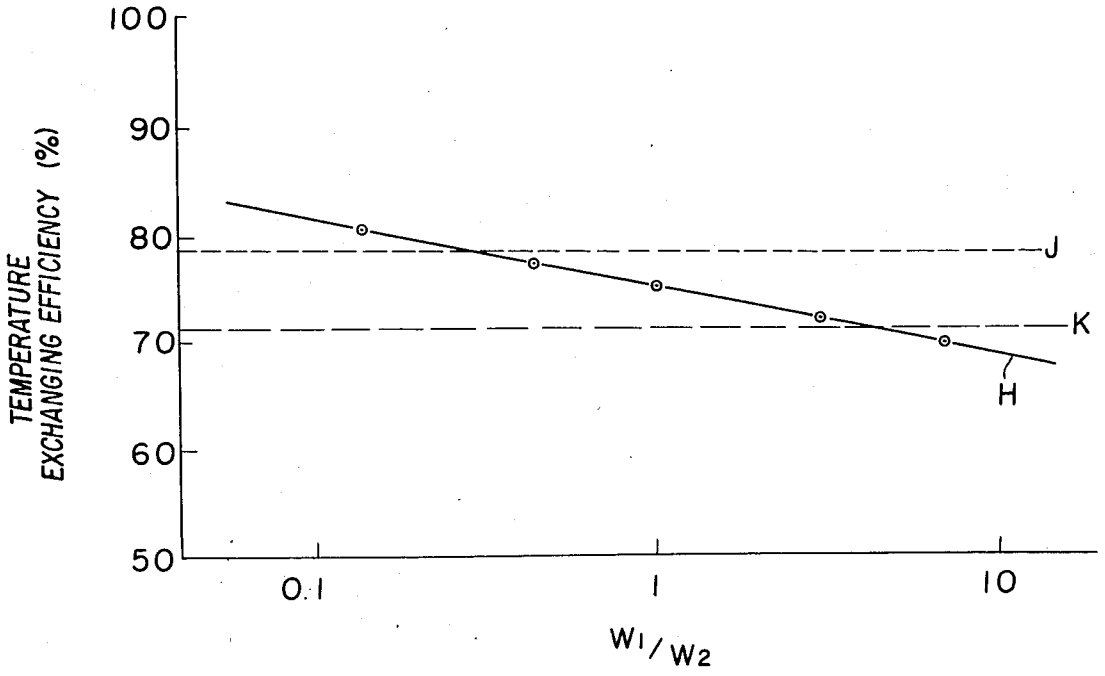
FIG. 7 is a graphical representation showing measured results of the temperature exchanging efficiency thereof.

As the performance of the heat exchanger, the temperature exchanging efficiency of the test heat exchanger was measured under the conditions of a standard quantity of air current to be processed of 400 $m^3$/hr. The results of the measurement are shown in FIG. 7, wherein the temperature exchanging efficiency is plotted in the axis of ordinate, and the ratio of $W_1/W_2$ is plotted in the axis of abscissa with a logarithmic graduation. As indicated in the graphical representation, the values are well positioned on the rectilinear line (H), which indicate that, as the value of the ratio $W_1/W_2$ becomes smaller, i.e., with the heat exchanger having the trapezoidal cross-section, the temperature exchanging efficiency is shown to be the highest. Furthermore, a temperature exchanging efficiency measured under the same conditions by use of an orthogonally intersecting flow type heat exchanger having the same heat transmitting area as that of the above-mentioned test heat exchanger, i.e., the orthogonally intersecting flow type heat exchanger having an equal heat transmitting area, was also indicated in FIG. 7 with a broken line K. In the same manner, the theoretical temperature exchanging efficiency calculated under the same conditions as the cross-flow type heat exchanger of an equal heat transmitting area was indicated in FIG. 7 with a broken line J. From FIG. 7, it has become apparent that the trapezoidal heat exchanger having the ratio $W_1/W_2$ of 0.14 breaks through the limits in the conventional plate-fin type heat exchanger, and which thus surpasses the theoretical temperature exchanging efficiency of the perfect cross-flow type heat exchanger.

Figure 8:
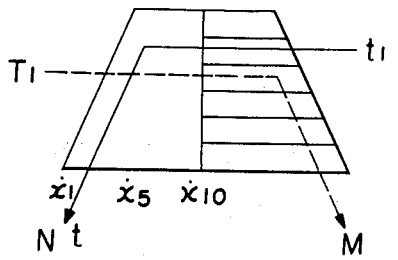
FIGS. 8(A), 8(B) and 8(C) are diagrams showing a flow rate distribution of an individual air current in the heat exchanger according to the present invention, and the flow rate distribution and the temperature distribution thereof at its outlet port.
Figure 8:
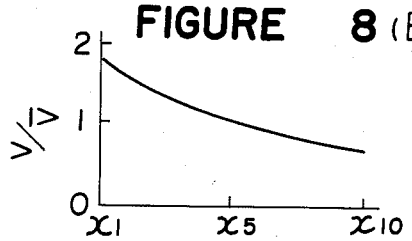
Figure 8:
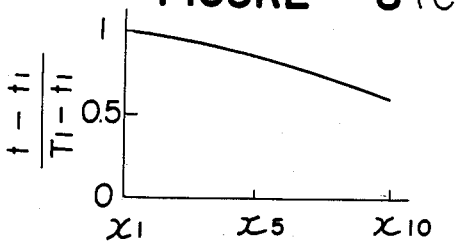

The above-described experimental facts are based on the flow rate distribution of air current at the fin section 7 and the empty section 12 of the heat exchanger according to the present invention, which can also be explained from the measured results of the flow rate distribution and temperature distribution of the air current. FIGS. 8(A), 8(B) and 8(C) show the results of measurements of the flow rate distribution and the temperature distribution of the air currents in the heat exchanger of the trapezoidal cross-section, and those of one of the air currents at the outlet port thereof. In FIG. 8(A), the flow rate distributions of the air current (N) in the solid line and the air current (M) in the broken line which is in contact with the air current (N) through the partitioning plate gather at the upper part in the drawing, where the static pressure loss is small, and the air currents are led by the spacer 10 which also functions as the guide for the air currents to be discharged outside through the outlet port, owing to which the flow rate distribution of the air current (N) at the outlet port is as shown in FIG. 8(B), where the ordinate indicates values obtained by standardizing the flow velocity V with an average flow velocity V, the value having assumed 1 at the substantially center position X5 in the outlet port. FIG. 8(C) shows a temperature distribution based on the results of measurement of the temperatures $T_1$ and $t_1$ of the air current (N) and the air current (M) respectively at their flow-in ports and the temperature t of the air current (N) at every position of the flow-out port thereof. From FIGS. 8(B) and 8(C), it is apparent that the air current gathers at a position of the flow-out port close to $$\frac{t - t_1}{T_1 - t_1} \approx 1$$

(corresponding to 100% of the temperature exchanging efficiency).

Figure 1A:
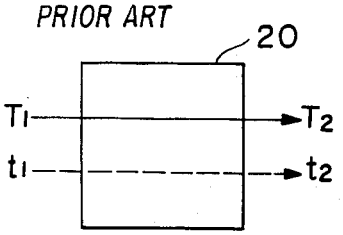
FIGURE 1(A) PRIOR ART
FIGS. 1(A), 1(B) and 1(C) are explanatory diagrams showing different types of the plate-fin type heat exchanger, and flow of fluids therein.
Figure 1B:
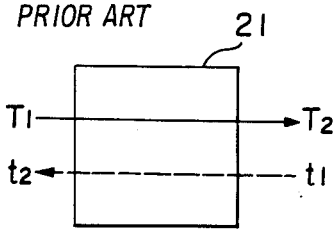
FIGURE 1(B) PRIOR ART
Figure 1C:
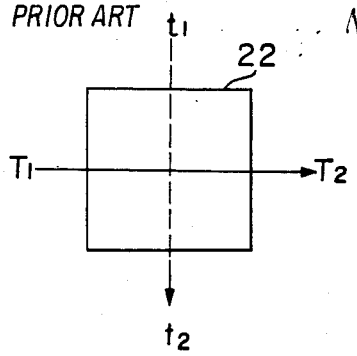
FIGURE 1(C) PRIOR ART
Figure 2:
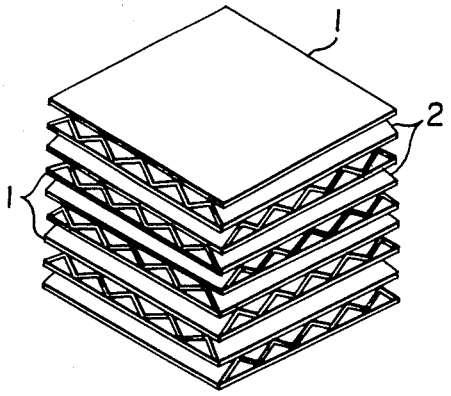
FIGURE 2 PRIOR ART
FIG. 2 is a perspective view of an conventional orthogonally intersecting flow type heat exchanger
Figure 3A:
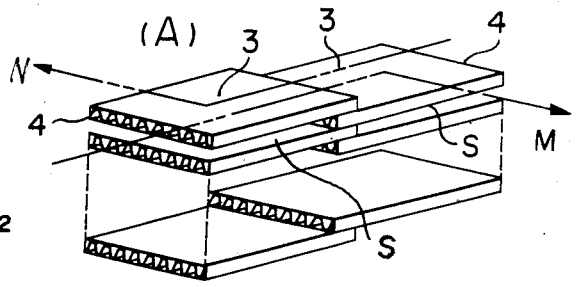
FIGURE 3(A) PRIOR ART
FIGS. 3(A) and 3(B) are respectively perspective views of a conventional heat exchanger which uses heat exchanging elements in a corrugated shape, and a closure plate.
Figure 3B:
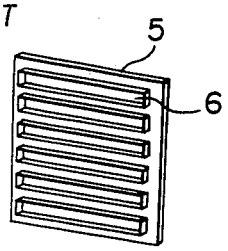
FIGURE 3(B) PRIOR ART
Figure 9:
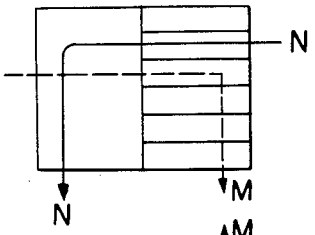
FIGS. 9(A), 9(B), 9(C) and 9(D) are diagrams showing air current patterns in the heat exchanger with a rectangular cross-section, as another embodiment of the present invention.
Figure 9:
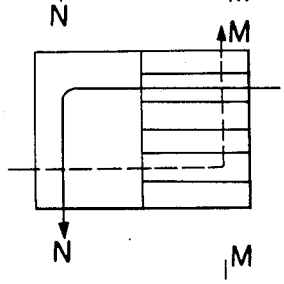
Figure 9:
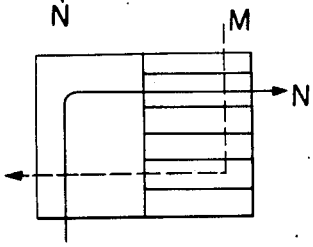
Figure 9:
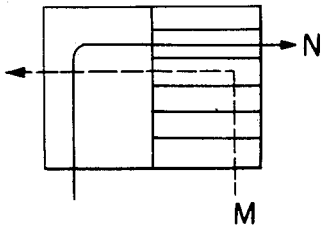

The present inventors named the plate-fin type heat exchanger according to the present invention "$\pi$-flow type heat exchanger" after its air current pattern shown in FIG. 8(A), which does not belong to any of the plate-fin type heat exchangers shown in FIG. 1 and yet surpasses the performance of the counter-flow type heat exchanger which has so far been considered ideal. As is apparent from the above-described experimental facts, the gist of the present invention is to realize the "$\pi$-flow type heat exchanger", the effect of which is exhibited particularly remarkably when the cross-sectional shape of the heat-exchanger is trapezoidal. On the other hand, even with the heat exchanger having the rectangular cross-section, the $\pi$-flow type heat exchanger can be realized, which is also included in the scope of the present invention. Therefore, following is an explanation as to the embodiment of the heat exchanger having the rectangular cross-section. FIGS. 9(A) to 9(D) show the air current patterns in the heat exchanger having the cross-sectional shape of a rectangle. FIG. 9(A) represents a case of the $\pi$-flow type heat exchanger according to the present invention, and FIGS. 9(B), 9(C) and 9(D) indicate other air current patterns of reference embodiments. The following Table 2 shows the measured results of the temperature exchanging efficiency of these heat exchangers mentioned above.

TABLE 2

| | Example of present invention | Reference Examples | | |
|---|---|---|---|---|
| | (A) | (B) | (C) | (D) |
| Temperature exchanging efficiency (%) | 76.6 | 74.6 | 71.8 | 72.1 |

As is apparent from Table 2 above, the $\pi$-flow type heat exchanger exhibited its excellent performance in comparison with the reference examples. Incidentally, the temperature exchanging efficiency of the rectangular heat exchanger having a ratio $W_1/W_2=1$ in FIG. 7 is represented by plotting average values of the heat exchanging efficiency of the heat exchangers shown in FIGS. 9(A) and 9(B), because this heat exchanger is situated intermediate of FIGS. 9(A) and 9(B).

Figure 10:
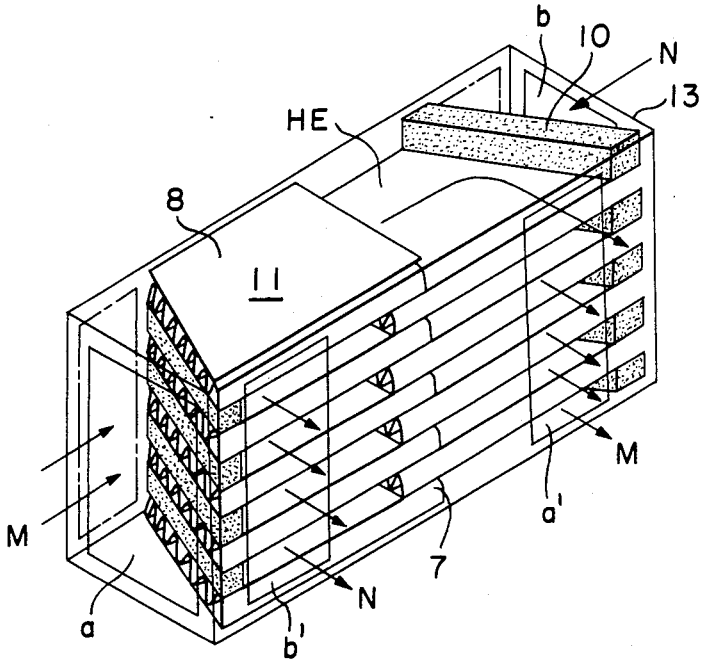
FIG. 10 is a perspective view of the heat exchanger according to the present invention having the trapezoidal cross-section when such is housed in a casing.

When the heat exchanger of the present invention is used as the heat exchanger for air conditioning, it is conveniently used by housing the heat exchanger in a casing 13, as shown in FIG. 10, having inlet ports and outlet ports for the air current formed therein. As a matter of course, in order to prevent air currents from being mixed each other, every main part of the casing is required to be sealed by use of sealant.

Although, in this embodiment, only the measured values of the temperature exchanging efficiency are shown, similar effects have been observed in relation to the humidity exchanging efficiency.

Furthermore, in this embodiment of the present invention, explanations have been given as to a case of carrying out an air-to-air heat exchange operation alone. However, as the same effect can be expected on any sort of fluid, the heat exchanger of the present invention is effective for the case of liquid-to-liquid heat exchange operation.

Figure 11:
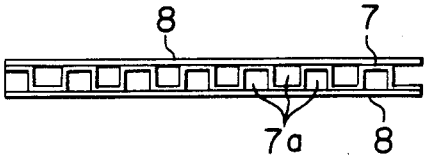
FIGS. 11, 12(A) and 12(B) are cross-sectional views showing modified embodiments of the fin and plate.
Figure 12:
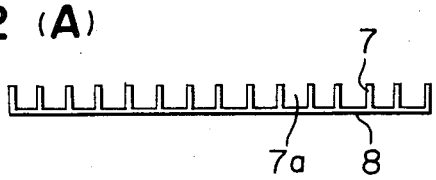
Figure 12:
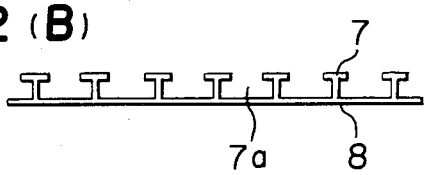

Also, the plate 8 is not always required to be of a flat surface, and any other surface conditions such as wavy, corrugated, and others may also attain the purpose of the present invention. Further, besides the planar shape which is folded in a wavy shape, the fin 7 may also be of a configuration as shown in FIGS. 11 and 12, for example, wherein the cross-sectional shape thereof is irregular, or it is formed by projecting from the plate 8 as an integral part thereof.

Figure 13:
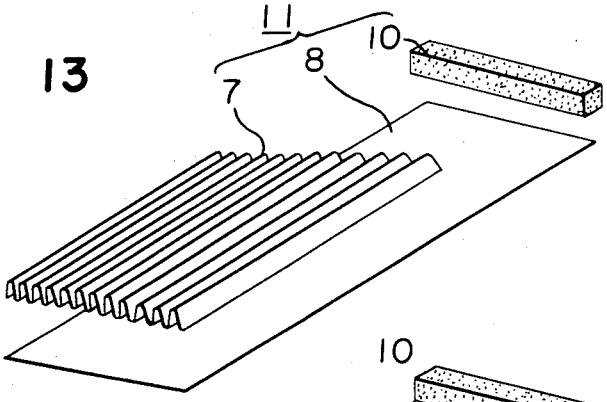
FIG. 13 is an exploded perspective view showing another embodiment of the unit member.
Figure 14:
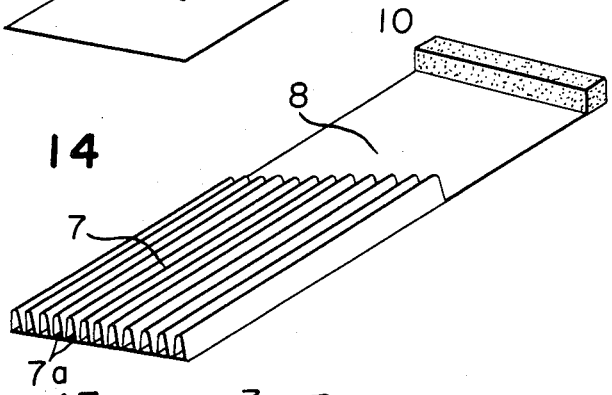
FIG. 14 is a perspective view of the unit member shown in FIG. 13, in its completed state.
Figure 15:
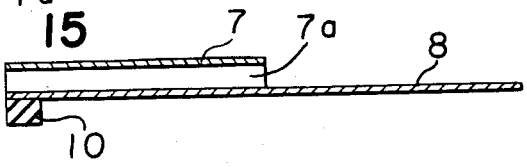
FIG. 15 is a longitudinal cross-sectional view showing still another embodiment of the unit member.

Furthermore, in the foregoing, the unit member 11 has been explained as being formed of four parts of the fin 7, the plates 8, 8 and the spacer 10. However, the unit member 11 may be constructed by providing the plate 8 at only one side of the fin 7 as shown in FIGS. 13 and 14, and then fitting the spacer 10 at one end part of the plate 8. When such unit members are stacked in sequence, the plates 8, 8 come to their positions at both surfaces of the fin 7, in the state of their stacking, thereby making it possible to attain the same effect as in the afore-described embodiment. Moreover, the spacer 10 may be provided at one end part of the side corresponding to the fin 7 as shown in FIG. 15 to construct the unit member 11.

The spacer 10 may not always be the part formed separately from the plate 8, and the end part of the plate 8 may be raised, this raised part possibly being used as the spacer 10.

Although, according to the embodiments shown in FIGS. 4 through 14, the unit members 11 are made in the exactly identical shape, hence these embodiments are suited for the industrialized mass-production, there may be obtained a heat exchanger of different configuration such as one having an asymmetrical shape at its left and right from the center (i.e., at the overlapped part of the unit member, each having non-identical shape), wherein, for example, two kinds of the unit member 11 having the same width but different lengths are prepared, and then these unit members are layed over one after the other with the long unit members being arranged at the right side and the short unit members being arranged at the left side on the march of the overlapping part of these unit members 11.

As has been explained in the foregoing with reference to the preferred embodiments, the heat exchanger according to the present invention which is characterized by its formation of a flow rate distribution proper to each fluid exhibits an excellent heat exchanging efficiency. In particular, the heat exchanger having the trapezoidal cross-section displayed an extremely high performance so as to exceed the heat exchanging efficiency of the counter-flow type heat exchanger which has so far been considered an ideal of the plate-fin type heat exchanger.

Incidentally, if the manufacture of the heat exchanger is made possible by stacking of the unit members, there can be expected other effect such that the automated manufacture of the heat exchanger becomes possible, which contributes to its industrialized mass-production with high efficiency.

What is claimed as new and desired to be secured by Letters Patent of the United States is:

1. A heat exchanger, comprising:

a plurality of partially overlapped plates disposed in mutual confrontation at predetermined spaced intervals to separate two fluids to be heat-exchanged;

a trapezoidally shaped fin disposed in said spaced interval among the mutually opposed plates to form a plurality of parallel flow paths for controlling flow of said two fluids in the space interval wherein the spaced intervals to be formed by said plates are in a plurality of stacked layers, and wherein an upstream portion where the fin is present and an empty space where no fin is present are so disposed in said plurality of spaced intervals in layer form that they are staggered in the direction of stacking the plates; and a control member obliquely provided in each of said spaced intervals in layer form to separate and alternately lead into each space interval a primary fluid and a secondary fluid so that the heat exchanging operation may be effected between said primary fluid and said secondary fluid as led into each of said spaced intervals in layer form through the partitioning plate in the course of their passage through said space interval in layer form, while producing a flow rate distribution in, and proper to, each of said fin section and said empty section by a static pressure loss distribution in the fin section wherein inlet ports for said two fluids to be heat-exchanged are provided on mutually opposite side surfaces and wherein outlet ports for said two fluids to be heat exchanged are provided on the same side surface.

2. A heat exchanger according to claim 1, wherein said control member further comprises a spacer member individually and separately disposed between said adjacent plates in each layer so as to form said spaced interval therebetween, and which has a size corresponding to said spaced interval formed by said mutually opposing plates; wherein said spacer member is disposed at an end part of said plate; and means for alternately introducing said fluids into each layer from the opposite side of the spacer through said fin section thereof and wherein said fluids are guided by said spacer in a predetermined lead-out direction.

3. A heat exchanger according to claim 1, wherein each of said plurality of layers further comprises a fin section provided at the upstream side of the flow of the fluid to be led into the layer where the fin is present, and an empty section provided at the downstream side thereof where no fin is present.

4. A heat exchanger according to claim 1, further comprising a plurality of unit members provided wherein each of said unit members further comprises a plate; a fin provided at one surface side of said plate; and a spacer provided on one and the same surface side with said fin at said plate and at a predetermined spaced interval, and wherein said unit members are stacked in a plurality of layers and an empty space part is formed in each stacked layer by a spaced interval between said fin and said spacer.

5. A heat exchanger according to claim 1, wherein said fin is a planar member having a corrugated shape in cross-section.

6. A heat exchanger according to claim 1, wherein said two fluids to be heat-exchanged further comprise fresh outside air and contaminated air to be discharged from a room.

7. A heat exchanger according to claim 1, wherein said plate further comprises a porous material having both a predetermined moisture permeability and gas intercepting property.

8. A heat exchanger according to claim 1, wherein said control member further comprises a spacer member individually and separately disposed between said adjacent plates in each layer so as to form said spaced interval therebetween and which has a size corresponding to the space interval formed by said mutually opposing plates.

9. A heat exchanger according to claim 8, further comprising a plurality of unit members wherein each of said unit members further comprises a plate; a fin provided at one surface side of said plate; and a spacer provided on said plate at an end part of a surface opposite to a surface where the fins are provided, and wherein said unit members are stacked in a plurality of layers such that an empty space part is formed in each stacked layer by a spaced interval between a spacer of one unit member and a fin of another unit member adjacent said first-mentioned unit member in a stacking direction.

10. A heat exchanger according to claim 8, further comprising a plurality of unit members wherein each of said unit members further comprises a pair of mutually opposing plates, a fin provided between said opposing plates, and a spacer provided on the same surface side of said fin on one of said plates and at a predetermined spaced interval with said fin wherein said unit members are stacked in a plurality of layers such that an empty space part is formed in each of said layers by a spaced interval between said fin and said spacer.

11. A heat exchanger according to claim 8, further comprising a plurality of unit members wherein each of said unit members further comprises a pair of mutually opposing plates, a fin provided between said opposing plates, and a spacer provided at an end part of the surface of one of said plates opposite to the surface where said fin is provided, wherein said unit members are stacked in a plurality of layers such that an empty space part is formed in each layer by a spaced interval between the spacer of one unit member and the fin of another unit member adjacent said first-mentioned unit member in a direction of stacking.

12. A heat exchanger according to claim 8, further comprising a plurality of unit members wherein each of said unit members further comprises a plate; a fin provided on one surface of said plate in such a manner that one end of the parallel flow paths thereof is coincident with one edge of said plate, said arranged end faces being oblique with respect to parallel flow paths; and wherein a spacer is provided at said obliquely formed end part on the surface of said plate opposite to the surface where said fin is provided, and wherein said unit members are stacked alternately in an opposite direction so that the end parts opposite to said obliquely formed end parts are overlapped, said unit members as stacked having a trapezoidal outer shape with said obliquely formed end parts constituting two sides thereof.

13. A heat exchanger according to claim 8, further comprising a plurality of unit members wherein each of said unit members further comprise a pair of plates disposed in mutual confrontation with one edge thereof being arranged in a predetermined position; a fin provided between said plates in such a manner that one end of the parallel flow paths thereof may be coincident with said arranged one edge of said plate, arranged end faces are oblique with respect to the parallel flow paths; and wherein a spacer is provided at said obliquely formed end part and on the surface of one of said plates opposite to the surface where said fin is provided, and wherein said unit members are stacked alternately in an opposite direction so that end parts opposite to said obliquely formed end parts are overlapped, said unit members as stacked having a trapezoidal outer shape with said obliquely formed end parts constituting the two sides thereof.

* * * * *